United States Patent [19]

Dignan

[11] Patent Number: 4,492,394

[45] Date of Patent: Jan. 8, 1985

[54] ADJUSTABLE-GRIP LATCH

[75] Inventor: Donald J. Dignan, South Euclid, Ohio

[73] Assignee: The Eastern Company, Cleveland, Ohio

[21] Appl. No.: 352,311

[22] Filed: Feb. 25, 1982

[51] Int. Cl.[3] ..... E05C 3/04

[52] U.S. Cl. ..... 292/64

[58] Field of Search ..... 292/67, 63, 58, 64, 292/57, 115, 69, 61, 60, 155, 212, 209; 70/125, 128, 83

[56] References Cited

U.S. PATENT DOCUMENTS

| | | | |
|---|---|---|---|
| 2,283,304 | 5/1942 | Williams | 292/212 |
| 2,285,728 | 6/1942 | Leinen | 292/212 |
| 2,334,012 | 11/1943 | Koch et al. | 292/212 X |
| 3,146,010 | 8/1964 | Dellith | 292/212 |

OTHER PUBLICATIONS

Camloc Latches Bulletin No. 87, C 1975, 1980, (actual date of publication unknown), Rexnord Inc., 2 pages.

Adjustable-Grip Latches, (no date known), Southco, Inc. pp. D-1 through D-9.

Fast Fastening by Dzus, (no date known), Dzus Fastener Co., Inc., pp. 1, 85, 86, 87.

Flush-Mounted Take-up & Lock Latches with Drop-T Handles, C. 1981, Eberhard Manufacturing Company, Section 1, pp. 19 & 20.

*Primary Examiner*—Richard E. Moore

*Attorney, Agent, or Firm*—David A. Burge

[57] ABSTRACT

An adjustable grip latch has a slippable, friction-type drive connection provided between a shaft and a pawl which is carried on the shaft. A stop extends alongside the shaft for limiting the travel of the pawl to a range of movement extending between latched and unlatched positions. When the pawl is in its latched position it engages one portion of the stop. When the pawl is in its unlatched position it engages a different portion of the stop. The slippable drive connection transmits only a limited amount of torque from the shaft to the pawl, thereby enabling the shaft to move the pawl between its latched and unlatched positions, and enabling the shaft to rotate relative to the pawl when the pawl has engaged the stop. The slippable drive connection utilizes a wave spring washer to effect transmission of limited torque from the shaft to the pawl.

24 Claims, 7 Drawing Figures

ADJUSTABLE-GRIP LATCH

CROSS-REFERENCE TO RELATED APPLICATIONS AND PATENTS

Reference is made to the following pending patent applications, the disclosures of which are incorporated herein by reference:

One-Piece Operator Head for a Tool-Operated Lock, design application, Ser. No. 199,548, filed Oct. 22, 1980, by Gordon G. Zeidman, issued Aug. 23, 1983, as U.S. Pat. No. De. 270,229.

Two-Piece Operator Head for a Tool-Operated Lock, design application, Ser. No. 199,549, filed Oct. 22, 1980, by Edwin W. Davis, et al, issued Sept. 27, 1983, as U.S. Pat. No. De. 270,707.

Tool and Operator Head for a Tool-Operated Lock, utility patent, Ser. No. 199,559, filed Oct. 22, 1980, by Donald L. Cooper, et al, issued Jan. 25, 1983, as U.S. Pat. No. 4,369,678.

Tool Operator for Tool-Operated Locks, design application, Ser. No. 199,547, filed Oct. 22, 1980, by Lee S. Weinerman, issued Sept. 6, 1983, as U.S. Pat. No. De. 270,424.

BACKGROUND OF THE INVENTION

1. Field of the Invention

The present invention relates generally to an adjustable-grip latch for releasably securing closures of industrial cabinets and the like. More particularly, the present invention relates to an adjustable-grip latch having a slippable, friction-type drive connection formed between an operating shaft and a pawl.

2. Prior Art

Adjustable-grip latches of a variety of configurations have been proposed for releasably securing industrial cabinet closures and the like. Such latches are particularly useful where it is desired (1) to compress a gasket which engages perimetrically-extending portions of a closure when the closure has been closed, or (2) to suppress vibration of a closure by clamping it snugly into engagement with such framework as defines the opening that is closed by the closure, or (3) to provide a tightly closing latch which will compensate for irregularities in manufacturing tolerances or for changes in dimensions due to wear.

One type of adjustable-grip latch which has been proposed includes a mounting ferrule, a shaft, a knob, a stop, a pawl, and a compression coil spring. A central portion of the shaft extends through and is journaled by the mounting ferrule. A forward end portion of the shaft carries the knob. A rearward end portion of the shaft is threaded into a threaded hole formed in the pawl. The stop extends alongside the rearward end portions of the shaft to limit the range of travel through which the pawl can move in response to rotation of the shaft. The compression coil spring is carried on the shaft, with one end of the spring engaging the pawl, and the other end engaging the mounting ferrule. The pawl and the stop are configured such that only a one-fourth turn of the shaft is needed to move the pawl between its latched and unlatched positions. The compression coil spring provides a slippable, friction-type drive connection for transmitting only a limited amount of torque from the shaft to the pawl, thereby enabling the shaft to move the pawl between its latched and unlatched positions, and enabling the shaft to rotate relative to the pawl when the pawl has engaged the stop.

The use of a compression coil spring to establish a slippable, drive connection between a pawl and a shaft in an adjustable-grip lock has a number of drawbacks. As the shaft is rotated relative to the pawl to move the pawl axially along the shaft, the degree to which the spring is compressed changes as the position of the pawl along the shaft is changed. One of the results of the change in spring compression is that the force required to turn the shaft increases with an increase in compression of the spring, and decreases as spring compression is relieved. Another result is that the torque which is transmitted from the shaft to the pawl during rotation of the shaft also varies. If the lengthy coil of wire which forms the spring should break at any point along its length, or if the open and exposed coils of the spring should become distorted, it is possible for the driving connection between the pawl and the shaft to fail, whereby neither latching or unlatching operations can be effected by rotating the shaft. Inasmuch as compression coil springs are relatively large in size, adjustable-grip latches which utilize compression coil springs are often found to require undesirably large mounting spaces.

SUMMARY OF THE INVENTION

The present invention overcomes the foregoing and other drawbacks of prior proposals by providing a latch which utilizes a wave spring washer to provide a slippable, friction-type drive connection between a pawl and a shaft which carries the pawl.

An important feature of the invention lies in the utilization of a wave spring washer to provide a slippable, friction-type drive connection between an operating shaft and a pawl. The wave spring washer is employed in such a way that its compression does not vary depending on the position of the pawl along the shaft. Inasmuch as the degree to which the wave spring washer is compressed does not vary during operation of the latch, neither the force required to turn the shaft, nor the amount of torque transmitted from the shaft to the pawl vary with changes in the position of the pawl along the shaft.

A feature of the invention lies in the significantly smaller design size which can be achieved where a thin, disc-like wave spring washer is utilized instead of the conventionally used compression coil spring. In the preferred practice of the invention, a further feature lies in the provision of a pawl with a housing structure which protectively encloses the spring washer to assure that it will not be accidentally deformed during installation or use of the latch.

A latch embodying the preferred practice of the present invention includes a mounting device such as a ferrule, an operating shaft which is journaled by the ferrule, and a pawl which is carried on the shaft. A stop extends alongside the shaft for limiting the range of movement of the pawl between latched and unlatched positions. A slippable, friction-type drive connection utilizing a wave spring washer limits the amount of torque that can be transmitted from the shaft to the pawl. The wave spring washer extends about the shaft and has opposed, axially-spaced face portions which may be compressed relatively axially in opposition to the spring action of the washer. The drive connection also includes structure which defines a pair of opposed surfaces which compressively engage the opposed face portions of the wave spring washer for transmitting torque from the shaft through the washer to the pawl.

These and other features and a fuller understanding of the invention may be had by referring to the following description and claims taken in conjunction with the accompanying drawings.

DESCRIPTION OF THE PREFERRED EMBODIMENTS

Figure 1:
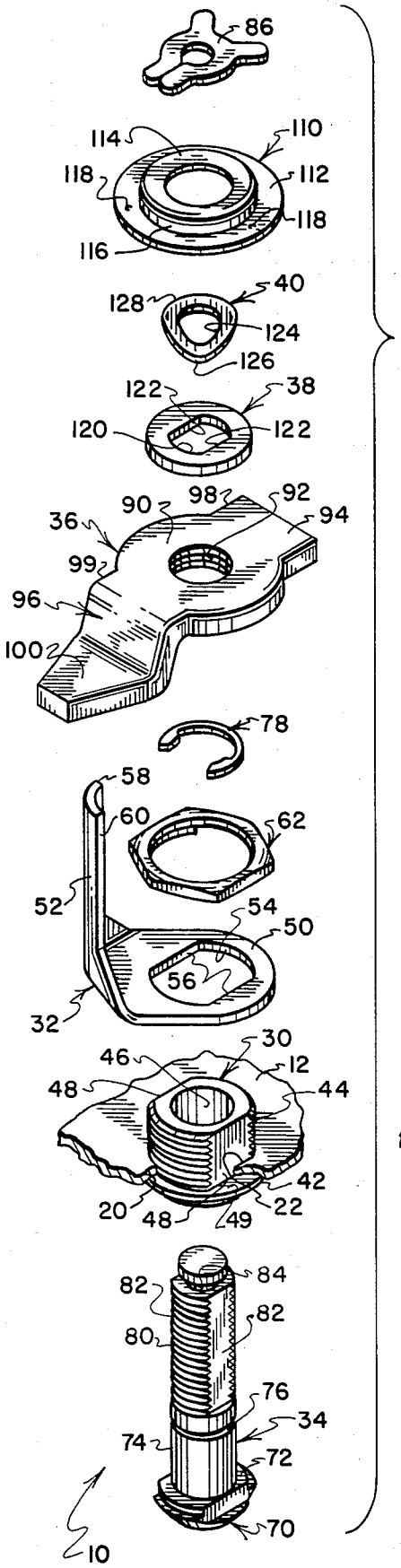
FIG. 1 is an exploded perspective view of one embodiment of a latch which includes features of the present invention.

Referring to FIGS. 1-4, one form of an adjustable-grip latch which embodies features of the present invention is indicated generally by the numeral 10. The latch 10 is mounted on a movable closure 12. A frame structure 14 carries a resilient, compressible gasket 16 for engaging perimetrically extending portions of the closure 12 when the closure 12 is closed. The frame structure 14 has a rear wall 18 which may be engaged and gripped by the latch 10 to securely hold the closure 12 in its closed position. A mounting hole 20 is formed through the closure 12. Portions of the latch 10 extend through the hole 20, as will be explained. A pair of flat surface portions one of which is indicated by the numeral 22 in FIG. 1, define opposite sides of the hole 20.

The principal components of the latch 10 include a mounting ferrule 30, a stop 32, an operating shaft 34, a pawl 36, a drive washer 38 and a wave spring washer 40. The washers 38, 40 cooperate to establish a slippable, friction-type drive connection between the shaft 34 and the pawl 36.

The mounting ferrule 30 has a relatively large diameter head 42, a threaded body 44, and a hole 46 which extends coaxially through the head 42 and the body 44 to define an axis of rotation for the shaft 34. A pair of flats 48 are formed on opposite sides of the body 44 for engaging the flat surface portions 22 which define opposite sides of the mounting hole 20 to prevent the ferrule 30 from turning in the mounting hole 20. A shoulder 49 is provided at the juncture of the head and body portions 42, 44 of the ferrule 30. The shoulder 49 engages the front face of the closure 12.

The stop 32 is an L-shaped member having a base portion 50 which engages the rear face of the closure 12, and a projecting portion 52 which extends rearwardly with respect to the closure 12. A mounting hole 54 is formed through the base portion 50. A pair of flat surfaces 56 define opposite sides of the hole 54. The threaded body 44 of the ferrule 30 extends through the hole 54, and the flats 48 formed on the body 44 engage the flat surfaces 56 to prevent relative turning movement between the stop 32 and the ferrule 30. A pair of stop surfaces 58, 60 are defined on opposite sides of the projecting portion 52. A nut 62 is threaded onto the body 44 of the ferrule 30. The nut 62 is tightened into engagement with the base portion 50 of the stop 32 to secure the ferrule 30 and the stop 32 rigidly in place on the closure 12.

The operating shaft 34 has an operating head 70 formed on its forward end. A radially extending shoulder 72 forms a transition between the operating head 70 and a cylindrical mounting portion 74. The mounting portion 74 extends through the hole 46 in the ferrule 30, and is journaled by the ferrule 30 for rotation. A circumferentially-extending groove 76 is formed in the mounting portion 74, and a crescent-shaped retaining ring 78 is seated in the groove 76. The retaining ring 78 engages the back of the ferrule 30, and the shoulder 72 engages the front of the ferrule 30, whereby the shaft 34 is retained in place with respect to the ferrule 30.

The operating shaft 34 has a rearwardly extending portion 80 which is threaded. A pair of flat drive surfaces 82 are formed on opposite sides of the threaded portion 80. A circumferentially extending groove 84 is formed near the rear end of the shaft 34. A resilient retaining clip 86 is seated in the groove 84.

The pawl 36 has a central portion 90. A threaded hole 92 is formed through the central portion 90. The threaded portion 80 of the shaft 34 is threaded into the hole 92 to mount the pawl 36 on the shaft 34.

Figure 2:
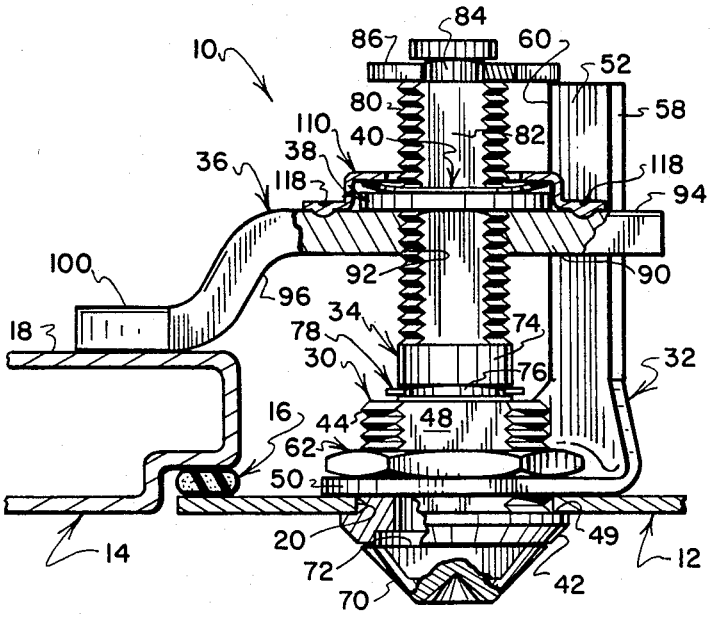
FIG. 2 is a top plan view of the latch of FIG. 1 installed on a closure and engaging a frame structure, with portions broken away.
Figure 3:
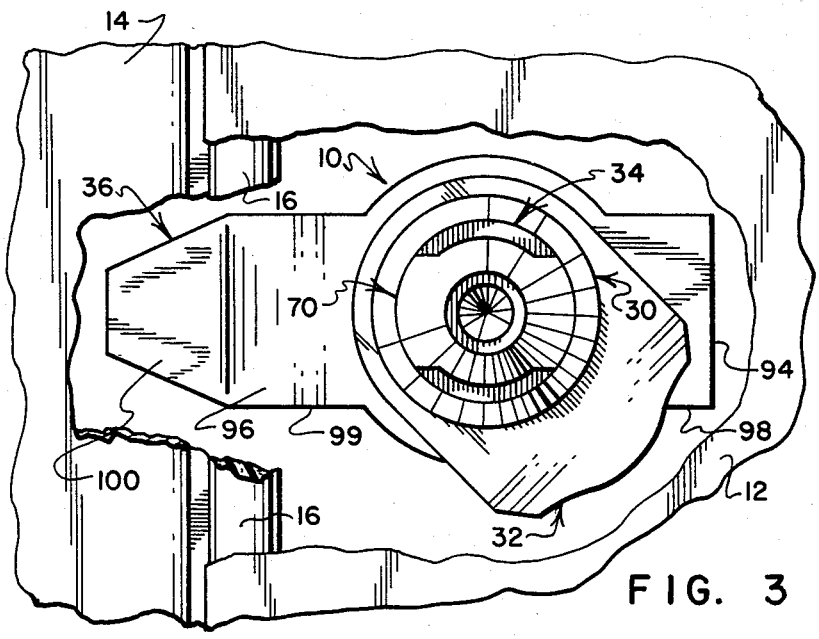
FIG. 3 is a front elevational view of the latch, closure and frame structure of FIG. 2, with the latch in its latched position, and with portions of the closure and frame broken away.

The pawl 36 has projecting arms 94, 96 which extend in opposite directions from the central portion 90. The arm 94 defines a stop surface 98. The arm 96 is of dog-legged configuration, and defines a stop surface 99 and a tapered tip 100. The pawl 36 is in its latched position when the tip 100 overlies the rear wall 18 of the frame structure 14, as is shown in FIGS. 2 and 3. The pawl 36 is in its unlatched osition when the tip 100 is rotated to the position shown in FIG. 4 wherein the tip 100 in no way obstructs opening of the closure 12. When the pawl 36 is in its latched position, its stop surface 98 engages the stop surface 58 formed on the stop 32. When the pawl 36 is in its unlatched position, its stop surface 99 engages the stop surface 60. By this arrangement, the stop surfaces 58, 60 98, 99 cooperate to limit the range of rotary movement through which the pawl 36 can travel.

The pawl 36 has a housing 110 secured to it for enclosing the washers 38, 40. The housing 110 has outer and inner flange portions 112, 114 which are joined by an axially extending shoulder 116. The outer flange 112 is spot welded at spaced points 118 to the central portion 90. The inner flange 114 surrounds the shaft 34 and cooperates with the central portion 90 to define a chamber within which the drive washer 38 and the wave spring washer 40 are housed.

The drive washer 38 has a hole 120 formed through it to receive the shaft 34. A pair of flat surfaces 122 define opposite sides of the hole 120 and drivingly engage the flat drive surfaces 82 on the shaft 34. The drive washer 38 has an outer diameter which lets it turn freely inside the shoulder 116 of the housing 110.

The wave spring washer 40 is a non-planar, axially-compressible spring steel member of a commercially available type. The washer 40 has a hole 124 formed through it to receive the shaft 34, and has opposed face portions 126, 128 which can be compressed axially toward each other. The washer 40 is of the type sold by Associated Spring Corporation of Bristol, Conn. under the part number WO618-008-5.

Figure 4:
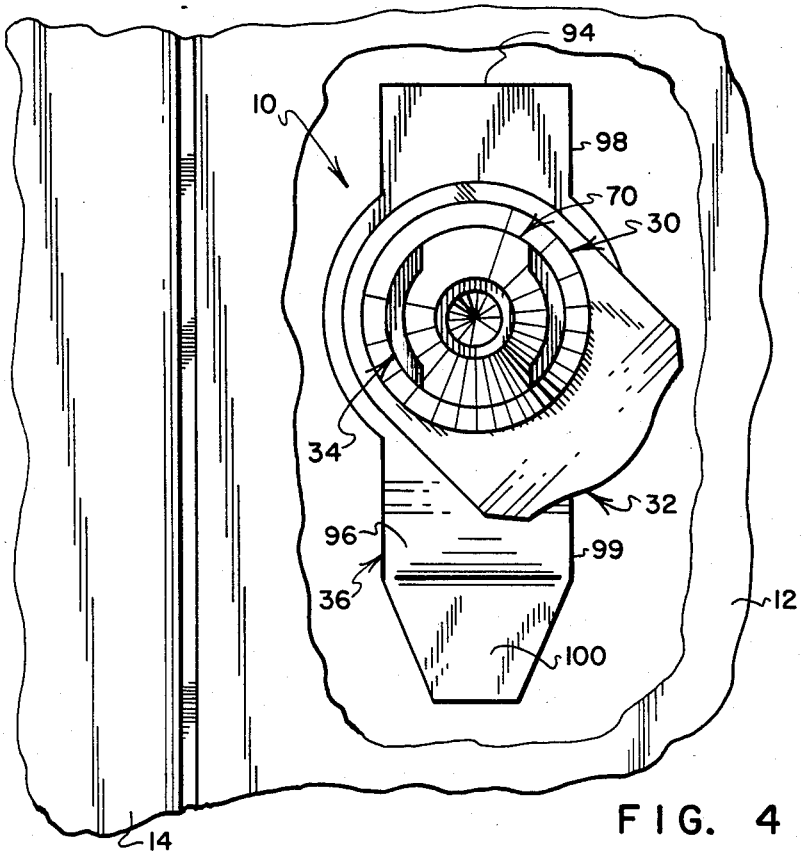
FIG. 4 is a front elevational view similar to FIG. 3 but with the latch in its unlatched position.

The housing 110 and the central portion 90 of the pawl 36 cooperate to compressively sandwich the washers 38, 40 to establish a slippable, friction-type drive connection between the shaft 34 and the pawl 36. In operation, when the shaft 34 is rotated counter-clockwise, as viewed in FIG. 3, the friction-drive connection transmits a sufficient amount of torque to the pawl 36 to rotate the pawl 36 from its latched position, as shown in FIG. 3, to its unlatched position, as shown in FIG. 4. When the pawl 36 reaches its unlatched position, its stop surface 99 engages the stop 32. If the shaft 34 continues to rotate in a counter-clockwise direction, the friction drive connection slips, thereby permitting the threaded portion 80 of the shaft 34 to thread out of the threaded hole 92 in the pawl 36. As the shaft 34 threads out of the hole 92, the pawl 36 is caused to move rearwardly along the shaft 34.

When the shaft 34 is rotated clockwise, as viewed in FIG. 4, the friction-drive connection transmits a sufficient amount of torque to the pawl 36 to rotate the pawl 36 from its unlatched position, as shown in FIG. 4, to its latched position, as shown in FIG. 3. When the pawl 36 reaches its latched position, its stop surface 98 engages the stop 32. If the shaft 34 continues to rotate in a clockwise direction, the friction drive connection slips, thereby permitting the threaded portion 80 of the shaft 34 to thread into the threaded hole 92 in the pawl 36. As the shaft 34 threads into the hole 92, the pawl 36 is caused to move forwardly along the shaft 34 to clampingly engage the rear face 18 of the frame 14, whereby the closure 12 is clamped into secure engagement with the gasket 16.

Figure 5:
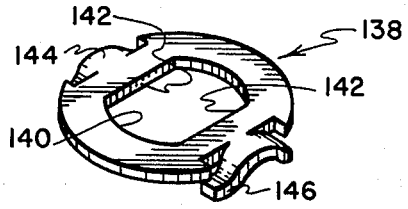
FIG. 5 is a perspective view of an alternate form of wave spring washer which may be employed in a latch which embodies features of the present invention.

Referring to FIG. 5, the washers 38, 40 may be replaced with a specially configured non-planar washer 138. The washer 138 has a hole 140 formed therethrough. A pair of flat surfaces 142 define opposite sides of the hole 140. The washer 138 has an upper surface 144 and wave-shaped formations 146 which depend from the planar body portion of the washer 138. The washer 138 thus forms an axially compressible structure which can be installed over the threaded end portion 80 of the shaft 34 with the flat surfaces 142 in driving engagement with the flat surfaces 82. Since the specially configured washer 138 rotates with the shaft 34, the engagement of its upper surface 144 and its depending formations 146 with the housing 110 and the central portion of the pawl 36 will establish a slippable, friction-type drive connection which will transmit limited torque from the shaft 34 to the pawl 36.

Figure 6:
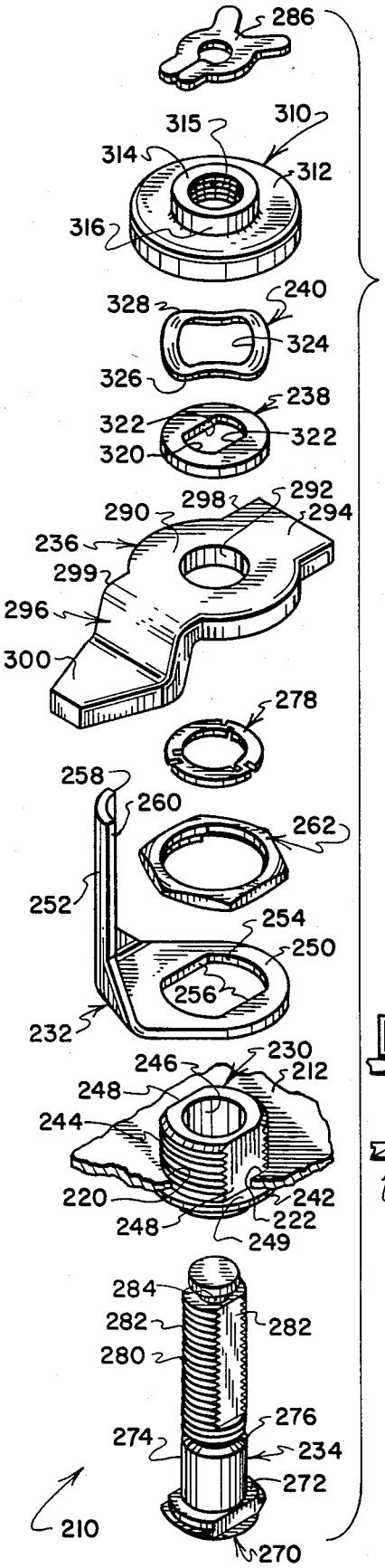
FIG. 6 is an exploded perspective view of an alternate embodiment of a latch which includes features of the present invention; and, FIG. 7 is a top plan view of the latch of FIG. 6 installed on a closure and engaging a frame structure, with portions broken away.
Figure 7:
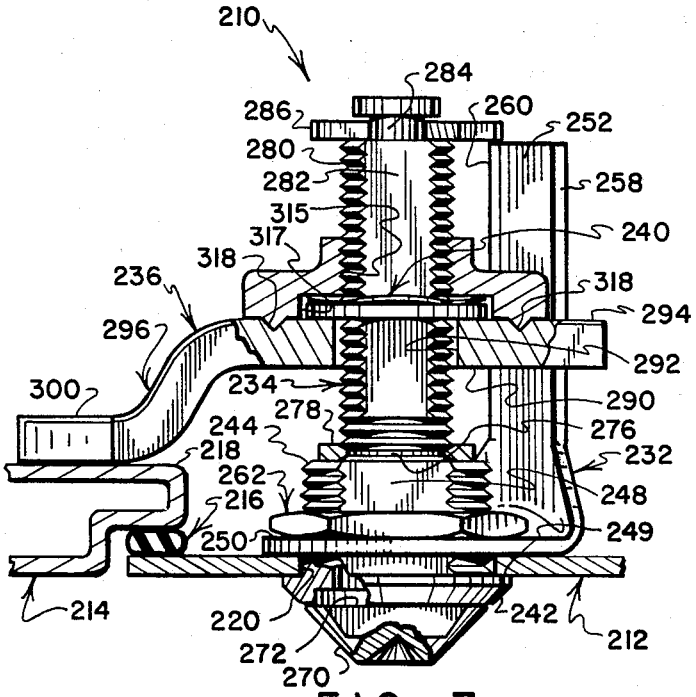

Referring to FIGS. 6 and 7, an alternate embodiment of an adjustable-grip latch incorporating features of the present invention is indicated generally by the numeral 210. The latch 210 is mounted on a movable closure 212. A frame structure 214 carries a resilient, compressible gasket 216 for engaging perimetrically extending portions of the closure 212 when the closure 212 is closed. The frame structure 214 has a rear wall 218 which may be engaged and gripped by the latch 210 to securely hold the closure 212 in its closed position. A mounting hole 220 is formed through the closure 212. Portions of the latch 210 extend through the hole 220, as will be explained. A pair of flat surface portions one of which is indicated by the numeral 222 in FIG. 6, define opposite sides of the hole 220.

The principal components of the latch 210 include a mounting ferrule 230, a stop 232, an operating shaft 234, a pawl 236, a drive washer 238 and a wave spring washer 240. The washers 238, 240 cooperate to establish a slippable, friction-type drive connection between the shaft 234 and the pawl 236.

The mounting ferrule 230 has a relatively large diameter head 242, a threaded body 244, and a hole 246 which extends coaxially through the head 242 and the body 244 to define an axis of rotation for the shaft 234. A pair of flats 248 are formed on opposite sides of the body 244 for engaging the flat surface portions 222 which define opposite sides of the mounting hole 220 to prevent the ferrule 230 from turning in the mounting hole 220. A shoulder 249 is provided at the juncture of the head and body portions 242, 244 of the ferrule 230. The shoulder 249 engages the front face of the closure 12.

The stop 232 is an L-shaped member having a base portion 250 which engages the rear face of the closure 212, and a projecting portion 252 which extends rearwardly with respect to the closure 212. A mounting hole 254 is formed through the base portion 250. A pair of flat surfaces 256 define opposite sides of the hole 254. The threaded body 244 of the ferrule 230 extends through the hole 254, and the flats 248 formed on the body 244 engage the flat surfaces 256 to prevent relative turning movement between the stop 232 and the ferrule 230. A pair of stop surfaces 258, 260 are defined on opposite sides of the projecting portion 252. A nut 262 is threaded onto the body 244 of the ferrule 230. The nut 262 is tightened into engagement with the base portion 250 of the stop 232 to secure the ferrule 230 and the stop 232 rigidly in place on the closure 212.

The operating shaft 234 has an operating head 270 formed on its forward end. A radially extending shoulder 272 forms a transition between the operating head 270 and a cylindrical mounting portion 274. The mounting portion 274 extends through the hole 246 in the ferrule 230, and is journaled by the ferrule 230 for rotation. A circumferentially-extending groove 276 is formed in the mounting portion 274, and a permanent shoulder retaining ring 278 is seated in the groove 276. The retaining ring 278 engages the back of the ferrule 230, and the shoulder 272 engages the front of the ferrule 230, whereby the shaft 234 is retained in place with respect to the ferrule 230.

The operating shaft 234 has a rearwardly extending portion 280 which is threaded. A pair of flat drive surfaces 282 are formed on opposite sides of the threaded portion 280. A circumferentially extending groove 284 is formed near the rear end of the shaft 234. A resilient retaining clip 286 is seated in the groove 284.

The pawl 236 has a central portion 290. A hole 292 is formed through the central portion 290. The threaded portion 280 of the 234 shaft extends through the hole 292 to mount the pawl 236 on the shaft 234.

The pawl 236 has projecting arms 294, 296 which extend in opposite directions from the central portion 290. The arm 294 defines a stop surface 298. The arm 296 is of dog-legged configuration, and defines a stop surface 299 and a tapered tip 300. The pawl 236 is in its latched position when the tip 300 overlies the rear wall 218 of the frame structure 214, as is shown in FIG. 7. The pawl 236 is in its unlatched position when the tip 300 is rotated to a position (like that shown in FIG. 4)

wherein the tip 300 in no way obstructs opening of the closure 212. When the pawl 236 is in its latched position, its stop surface 298 engages the stop surface 258 formed on the stop 232. When the pawl 236 is in its unlatched position, its stop surface 299 engages the stop surface 260. By this arrangement, the stop surfaces 258, 260 298, 299 cooperate to limit the range of rotary movement through which the pawl 236 can travel.

The pawl 236 has a housing 310 secured to it for enclosing the washers 238, 240. The housing 310 has outer and inner flange portions 312, 314 which are joined by an axially extending shoulder 316. The outer flange 312 is spot welded at spaced points 318 to the central portion 290. The inner flange 314 has a threaded hole 315 through which the shaft 234 is threaded. Referring to FIG. 7, the housing 310 cooperates with the central portion 290 of the pawl 236 to define a chamber 317 within which the drive washer 238 and the wave spring washer 240 are housed.

The drive washer 238 has a hole 320 formed through it to receive the shaft 234. A pair of flat surfaces 322 define opposite sides of the hole 320 and drivingly engage the flat drive surfaces 282 on the shaft 234. The drive washer 238 has an outer diameter which lets it turn freely inside the chamber 317 of the housing 310.

The wave spring washer 240 is a non-planar, axially-compressible spring steel member of a commercially available type. The washer 240 has a hole 324 formed through it to receive the shaft 234, and has opposed face portions 326, 328 which can be compressed axially toward each other. The washer 240 is of the type sold by Associated Spring Corporation of Bristol, Conn. under the part number U-375-0090.

The housing 310 and the central portion 290 of the pawl 236 cooperate to compressively sandwich the washers 238, 240 to establish a slippable, friction-type driven connection between the shaft 234 and the pawl 236. The operation, the latch 210 performs in exactly the same manner as the latch 10.

It will be understood that the type of operator head which is used to rotate the shafts 34, 234 can take any of a wide variety of forms, and can, if desired, simply comprise a knob. The operator heads 70, 270 depicted in the drawings are of the type disclosed in referenced U.S. Pat. No. 270,707 and U.S. Pat. No. 4,369,678. A similar operating head which may be used with latches embodying features of the present invention is disclosed in referenced U.S. Pat. No. 270,229. Tools which may be used to rotate the operator heads 70, 270 are disclosed in referenced U.S. Pat. No. 270,424 and U.S. Pat. No. 4,369,678.

Although the invention has been described in its preferred form with a certain degree of particularity, it is understood that the present disclosure of the preferred form has been made only by way of example and numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A latch, comprising:

(a) a shaft of generally round cross section having threads on at least a part of the shaft;

(b) stop means;

(c) mounting means mounting the shaft for rotation about an axis, and positioning the stop means near the shaft;

(d) pawl means carried by the shaft for threadably engaging the threaded part of the shaft, the pawl means including friction drive means for transmitting limited torque from the shaft to the pawl means to urge the pawl means to rotate about the axis together with the shaft;

(f) the pawl means and the stop means being configured such that:

(i) when the shaft is rotated about the axis in one direction, torque is transmitted from the shaft to the pawl means through the friction drive means to rotate the pawl means with the shaft toward a latched position wherein the pawl means engages the stop means, and, once the pawl means has engaged the stop means, to thereafter restrain further rotary movement of the pawl means as the shaft continues to be rotated, whereby the threaded engagement between the shaft and the pawl means causes the pawl means to travel axially along the shaft as the shaft is rotated relative to the pawl means;

(ii) when the shaft is rotated about the axis in the opposite direction, torque is transmitted from the shaft to the pawl means through the friction drive means to rotate the pawl toward an unlatched position wherein the pawl means engages the stop means, and, once the pawl means has engaged the stop means, to thereafter restrain further rotary movement of the pawl means as the shaft continues to be rotated, whereby the threaded engagement between the shaft and the pawl means causes the pawl means to travel axially along the shaft as the shaft is rotated relative to the pawl means;

(g) the friction drive means including:

(i) a compressible spring washer which extends about a part of the shaft, the washer having opposed, axially-spaced face portions which may be compressed relatively axially in opposition to the spring action of the spring washer; and, (ii) connection means compressively engaging the opposed face portions of the spring washer and establishing a frictional drive connection for transmitting torque from the shaft to the pawl means.

2. A latch, comprising:

(a) a shaft;

(b) a pawl carried by the shaft;

(c) a stop;

(d) mounting means mounting the shaft for rotation about an axis, and positioning the stop near the shaft;

(e) friction drive means for transmitting limited torque from the shaft to the pawl to urge the pawl to rotate about the axis together with the shaft;

(f) the pawl and the stop being configures such that:

(i) when the shaft is rotated about the axis in one direction, torque transmitted to the pawl through the friction drive means tends to move the pawl toward a latched position wherein the pawl engages the stop; and, (ii) when the shaft is rotated about the axis in the opposite direction, torque transmitted to the pawl through the friction drive means tends to move the pawl toward an unlatched position wherein the pawl engages the stop;

(g) the friction drive means including:

(i) a compressible spring washer which extends about a part of the shaft, the washer having opposed, axially-spaced face portions which may be compressed relatively axially in opposition to the spring action of the spring washer;

(ii) connection means compressively engaging the opposed face portions of the spring washer and establishing a frictional drive connection for transmitting torque from the shaft to the pawl, the connection means including structure defining spaced, opposed planar drive surfaces which extend transverse to the axis, which encircle the shaft, and which engage the opposed face portions of the spring washer;

(h) the shaft carrying a washer-like member which is drivingly connected to the shaft for rotation therewith; and, (i) one of the planar drive surfaces being formed on the pawl, and the other being formed on the washer-like member.

3. The latch of claim 2 wherein the shaft has a flat surface extending axially therealong, and the washer-like member is configured to engage the flat surface to establish a driving connection between the washer-like member and the shaft.

4. The latch of claim 2 wherein the pawl includes housing structure defining a housing which at least partially encloses the spring washer.

5. The latch of claim 4 wherein one of the planar drive surfaces is formed on the housing structure.

6. A adjustable-grip latch, comprising:

(a) mounting means having a hole formed therethrough, with the hole being oriented to extend along an axis;

(b) a shaft extending through the hole and being journaled by the mounting means, the shaft having a forward portion extending in a forward direction relative to the mounting means, and having a rearward portion extending in a rearward direction relative to the mounting means;

(c) operating formation means connected to the forward portion of the shaft for engagement by an operator to turn the shaft about its axis;

(d) drive formation means connected to the rearward portion of the shaft including a first threaded surface, and, a drive formation;

(e) a pawl carried by the rearward portion of the shaft, the pawl having a structure which defines a second threaded surface, the second threaded surface being threaded onto the first threaded surface;

(f) friction drive means for transmitting torque from the shaft to the pawl, including:

(i) a compressible spring washer extending about the rearward portion of the shaft, the washer having opposed, axially-spaced face portions which may be compressed relatively axially in opposition to the spring action of the spring washer, and, (ii) connection means connected to the pawl, connected to the drive formation on the shaft, and compressively engaging the opposed face portions of the spring washer for establishing a friction-type drive connection to transmit torque from the shaft to the pawl to urge the pawl to turn in unison with the shaft, the connection means including structure defining spaced, opposed planar drive surfaces which extend transverse to the axis, which encircle the shaft, and which engage the opposed face portions of the spring washer; and, (g) a washer-like member being carried by the shaft, with the washer-like member being connected to the shaft for rotation therewith, and with one of the planar drive surfaces being formed on the washer-like member.

7. The latch of claim 6 wherein the washer-like member is configured to engage the drive formation on the shaft to establish a driving connection between the washer-like member and the shaft.

8. The latch of claim 7 wherein the drive formation includes a flat, axially-extending surface formed on the shaft, and the washer-like member has a hole through which the shaft extends, with the hole being configured to drivingly engage the flat, axially-extending surface on the shaft.

9. An adjustable-grip latch, comprising:

(a) mounting means having a hole formed therethrough, with the hole being oriented to extend along an axis;

(b) a shaft extending through the hole and being journaled by the mounting means, the shaft having a forward portion extending in a forward direction relative to the mounting means, and having a rearward portion extending in a rearward direction relative to the mounting means;

(c) operating formation means connected to the forward portion of the shaft for engagement by an operator to turn the shaft about its axis;

(d) drive formation means connected to the rearward portion of the shaft including a first threaded surface, and a drive formation;

(e) pawl means carried by the rearward portion of the shaft, the pawl means having a structure which defines a second threaded surface, the second threaded surface being threaded onto the first threaded surface;

(f) friction drive means for transmitting torque from the shaft to the pawl means, including:

(i) a compressible spring washer extending about the rearward portion of the shaft, the washer having opposed, axially-spaced face portions which may be compressed relatively axially in opposition to the spring action of the spring washer; and, (ii) connection means connected to the pawl means, connected to the drive formation on the shaft, and compressively engaging the opposed face portions of the spring washer for establishing a friction-type drive connection to transmit torque from the shaft to the pawl to urge the pawl to turn in unison with the shaft; and, (g) stop means for engaging the pawl means to limit the turning movement of the pawl means in response to turning movement of the shaft about the axis, for defining latched and unlatched positions at opposite ends of a permitted range of turning movement of the pawl means, and for preventing rotation of the pawl means beyond the latched and unlatched rotations, whereby the shaft is caused to rotate relative to the pawl means if rotation of the shaft is continued after the pawl means is rotated to one of its latched and unlatched positions, and the pawl means is caused to move relatively axially along the shaft due to the threaded engagement of the first and second threaded surfaces.

10. The latch of claim 9 wherein the operating formation means includes head structure with drive surface portions which are engageable by a tool for rotating the shaft.

11. The latch of claim 9 wherein the connection means includes structure defining spaced, opposed drive surfaces that extend transverse to the axis, which encircle the shaft, and which engage the opposed face portions of the spring washer.

12. The latch of claim 11 wherein one of the drive surfaces is formed on the pawl means.

13. The latch of claim 11 wherein the connection means includes a washer-like member that is drivingly connected to the shaft for rotation therewith, and one of the drive surfaces is formed on the washer-like member.

14. The latch of claim 13 wherein the washer-like member has a mating formation that is configured to engage the drive formation on the shaft to establish a driving connection between the washer-like member and the shaft.

15. The latch of claim 14 wherein:

(a) the drive formation means includes a flat, axially-extending surface formed on the shaft;

(b) the washer-like member has a hole through which the shafts extends; and, (c) the mating formation means includes a flat surface portion defining a part of the hole with the flat surface portion being configured to drivingly engage the flat, axially-extending surface on the shaft.

16. The latch of claim 11 wherein the pawl means includes a housing structure that defines a housing which at least partially encloses the spring washer.

17. The latch of claim 16 wherein one of the drive surfaces is formed on the housing structure.

18. The latch of claim 1 wherein the connection means includes structure defining spaced, opposed planar drive surfaces that extend transverse to the axis, which encircle the shaft, and which engage the opposed face portions of the spring washer.

19. The latch of claim 18 wherein one of the planar drive surfaces is formed on the pawl means.

20. The latch of claim 18 wherein the shaft carries a washer-like member that is drivingly connected to the shaft for rotation therewith, and one of the planar drive surfaces is formed on the washer-like member.

21. The latch of claim 20 wherein the wherein the shaft has at least some of the threads interrupted by the provision of a drive formation that extends along at least a portion of the threaded portion of the shaft and is a flat surface that extends axially therealong, and the washer-like member is configured to engage the flat surface to establish a driving connection between the washer-like member and the shaft.

22. The latch of claim 20 wherein the pawl means includes a housing structure defining a housing which at least partially encloses the spring washer.

23. The latch of claim 22 wherein one of the planar drive surfaces is defined by the housing structure.

24. The latch of claim 1 wherein the mounting means includes:

(a) a ferrule which journals the shaft; and, (b) a bracket which embraces the ferrule and which extends alongside the shaft to define the stop.

* * * * *